US007566212B2

(12) United States Patent
Nishikata et al.

(10) Patent No.: US 7,566,212 B2
(45) Date of Patent: Jul. 28, 2009

(54) VANE PUMP WITH BLADE BASE MEMBERS

(75) Inventors: Masaaki Nishikata, Fukuoka (JP); Toshiyuki Kubota, Kasuga (JP); Tsuyoshi Kusakabe, Chikushi (JP); Harumi Fukuki, Kasuga (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 12/000,039

(22) Filed: Dec. 7, 2007

(65) Prior Publication Data

US 2008/0138198 A1 Jun. 12, 2008

(30) Foreign Application Priority Data

Dec. 8, 2006 (JP) ..... 2006-332433

(51) Int. Cl.
*F03C 2/00* (2006.01)
*F03C 18/00* (2006.01)

(52) U.S. Cl. ..... 418/259; 418/111; 418/143; 418/268

(58) Field of Classification Search ..... 418/259, 418/266–268, 111, 140, 141, 143, 144
See application file for complete search history.

(56) References Cited

U.S. PATENT DOCUMENTS 600,723 A * 3/1898 Johnson ..... 418/112
1,860,872 A * 5/1932 Price et al. ..... 251/98
3,031,975 A * 5/1962 Erdmann ..... 418/267
3,196,856 A * 7/1965 Ward ..... 418/111
3,586,867 A * 6/1971 Maillet ..... 290/52
3,908,608 A * 9/1975 Fox ..... 123/213
6,866,491 B2 * 3/2005 Maeng ..... 418/112

FOREIGN PATENT DOCUMENTS

CN 1764784 4/2006
WO WO 2005/003562 1/2005

* cited by examiner

*Primary Examiner*—Theresa Trieu
(74) *Attorney, Agent, or Firm*—Bacon & Thomas, PLLC

(57) ABSTRACT

A vane pump includes a rotor accommodated in a rotor chamber; a plurality of vanes attached to the rotor, each of the vanes having a leading end adapted to make sliding make a contact with an inner peripheral surface of the rotor chamber. Further, the vane pump includes working compartments surrounded by inner surfaces of the rotor chamber, an outer peripheral surface of the rotor and the vanes, the working compartments being adapted to undergo a volume change as the rotor is rotatably driven; an inlet port through which a working fluid is drawn into a working compartment whose volume is being increased; and an outlet port through which the working fluid is discharged from a working compartment whose volume is being decreased; and one or more blade base members protruded from portions on the outer peripheral surface of the rotor between the vanes adjacent to each other.

6 Claims, 9 Drawing Sheets

VANE PUMP WITH BLADE BASE MEMBERS

FIELD OF THE INVENTION

The present invention relates to a vane pump.

BACKGROUND OF THE INVENTION

Typical vane pumps known in the art include, e.g., the one illustrated in FIG. 10. This vane pump 1 has a rotor chamber 2 and a rotor 3 eccentrically accommodated in the rotor chamber 2. A plurality of vane grooves 19 is radially formed in the rotor 3 and vanes 4 are slidably moved in the respective vane grooves 19. Each of the vanes 4 is free to move in a radial direction of the rotor 3. As the rotor 3 is rotatably driven, the leading ends of the respective vanes 4 make sliding contact with the inner peripheral surface 2*a* of the rotor chamber 2, whereby working compartments 5 surrounded by inner surfaces of the rotor chamber 2, an outer peripheral surface 3*a* of the rotor 3 and the vanes 4 undergo a volume change and a working fluid drawn into the working compartments 5 from an inlet port 6 is discharged through an outlet port 7. For example, Japanese Patent Laid-open Application No. S62-291488 discloses the same vane pump as the one shown in FIG. 10.

It is possible for the vane pump shown in FIG. 10 to pressurize the working fluid in the working compartments 5 by the vanes 4 protruded from the outer peripheral surface 3*a* of the rotor 3. Since, however, portions of the outer peripheral surface 3*a* of the rotor 3 between adjacent vanes 4 have a smooth circular arc shape without unevenness, it is difficult to make strong-enough fluid flow in the working compartments 5. Accordingly, the fluid pressure in the working compartments 5 may not be high enough, resulting in the pump performance which can be further improved.

SUMMARY OF THE INVENTION

In view of the above, the present invention provides a vane pump capable of increasing the pressure of working fluid in a working compartment and effectively pumping the working fluid through an outlet port to thereby improve the pump performance.

In accordance with embodiments of the present invention, there is provided a vane pump including: a rotor accommodated in a rotor chamber; a plurality of vanes attached to the rotor, each of the vanes having a leading end adapted to make sliding contact with an inner peripheral surface of the rotor chamber; working compartments surrounded by inner surfaces of the rotor chamber, an outer peripheral surface of the rotor and the vanes, the working compartments being adapted to undergo a volume change as the rotor is rotatably driven; an inlet port through which a working fluid is drawn into a working compartment whose volume is being increased; and an outlet port through which the working fluid is discharged from a working compartment whose volume is being decreased; and one or more blade base members protruding from portions between the vanes adjacent to each other on the outer peripheral surface of the rotor.

By the blade base members provided in the rotor rotatably driven, vortex flows are generated in the working fluid in the working compartments formed between the outer peripheral surface of the rotor and the inner peripheral surface of the rotor chamber. Therefore, the pressure of the working fluid in the working compartments can be increased to thereby effectively pump out the working fluids through the outlet port.

Preferably, a plurality of blade base members is disposed in a circumferential direction of the rotor and is protruded from the portions between the vanes adjacent to each other, and blade base grooves are formed between the blade base members adjacent to each other and are opened at one or both of an upper and a lower thrust surface of the rotor.

By providing the blade base grooves opened at the thrust surfaces of the rotor, the working fluid in the blade base grooves can make contact with an inner surface of the rotor chamber facing the corresponding openings to generate flows of the working fluid. Consequently, the pressures of the working fluid in the working compartments can be increased to thereby effectively pump out the working fluids through the outlet port.

Preferably, the blade base grooves are opened at one of the thrust surfaces and a guide surface is formed at a leading side of each of the blade base members as viewed in a rotating direction of the rotor, and wherein at least a portion of the guide surface disposed at a side of said one of the thrust surfaces is configured such that the closer to said one of the thrust surface a part of the guide surface is, the more trailing side the part of the guide surface is located as viewed in the rotating direction of the rotor.

Therefore, as the rotor is rotatably driven, the guide surfaces can generate vortex flows in the working fluid, which flow from the blade base grooves to the upper thrust surface. Accordingly, the pressure of the working fluid in the working compartments can be increased to thereby effectively pump out the working fluids through the outlet port.

Preferably, a leading side of each of the blade base members as viewed in a rotating direction of the rotor is formed such that a central part of the leading side in a thrust direction of the rotor is positioned at a trailing side of two opposite end parts of the leading side as viewed in the rotating direction of the rotor.

Therefore, as the rotor is rotatably driven, vortex flows are generated in the working fluid in the blade base grooves to flow from both sides in the thrust direction of the rotor toward the center. Accordingly, the pressure of the working fluid in the working compartments increases and the working fluid can be effectively pumped out through the outlet port.

Preferably, a free end of each of the blade base members that are protruded from the outer peripheral surface of the rotor extends toward a leading side of a rotating direction of the rotor.

Therefore, as the rotor is rotatably driven, vortex flows are generated in the working fluid in the blade base grooves to flow from the protruding ends of the blade base members toward the base ends thereof. As a consequence, the pressure of the working fluid in the working compartments increases, and the working fluid can be effectively pumped out through the outlet port.

BRIEF DESCRIPTION OF THE DRAWINGS

The objects and features of the present invention will become apparent from the following description of preferred embodiments given in conjunction with the accompanying drawings, in which.

DETAILED DESCRIPTION OF THE EMBODIMENTS

Figure 1:
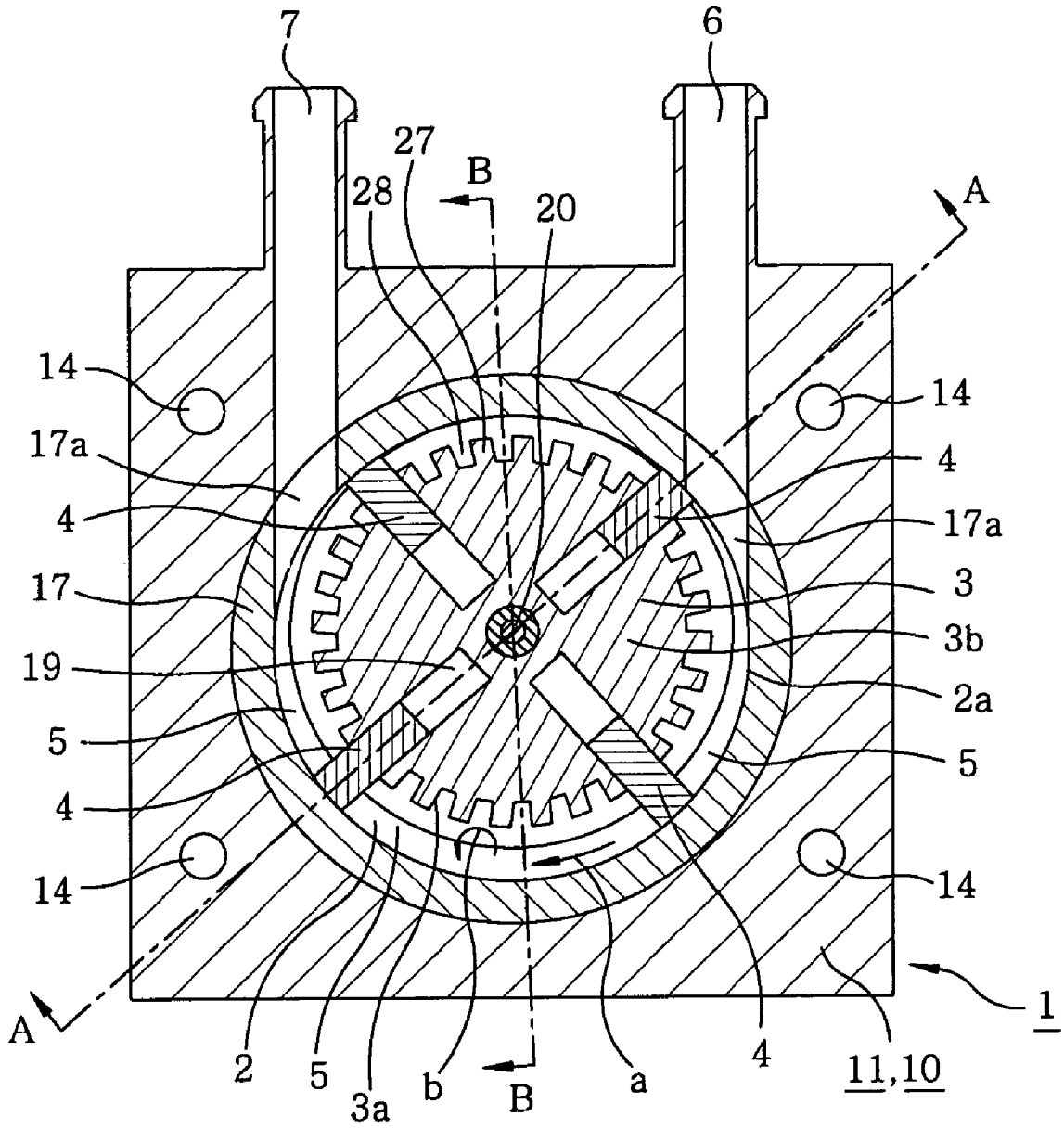
FIG. 1 shows a cross sectional view illustrating an exemplary vane pump in accordance with an embodiment of the present invention.
Figure 2:
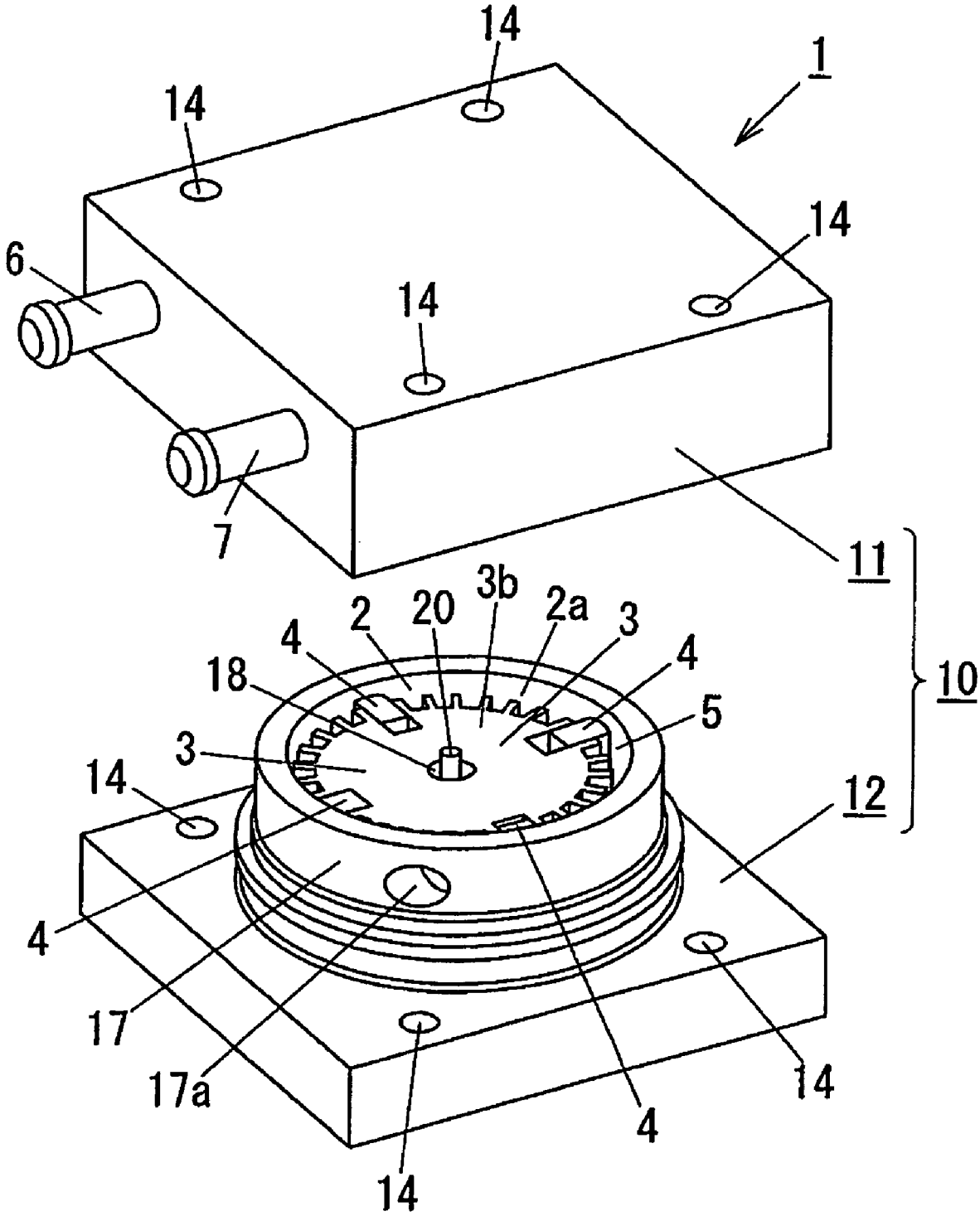
FIG. 2 shows an exploded perspective view of the vane pump illustrated in FIG. 1.
Figure 3:
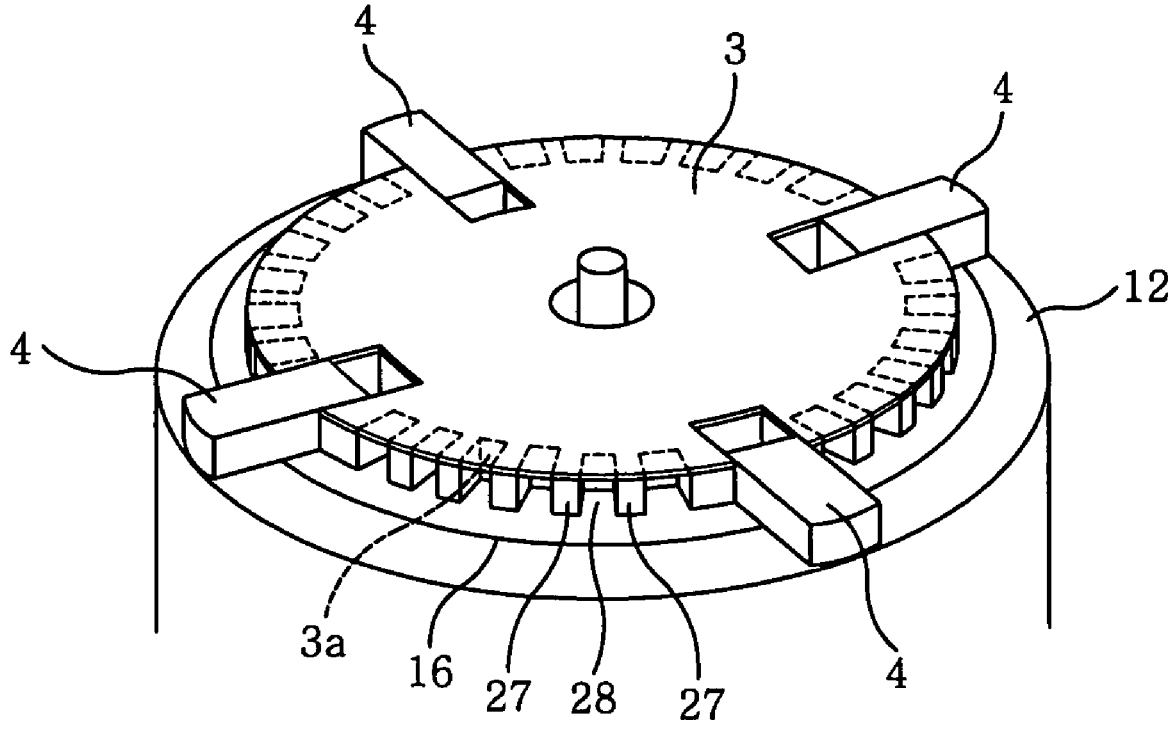
FIG. 3 shows a perspective view illustrating blade base members of a rotor.
Figure 4A:
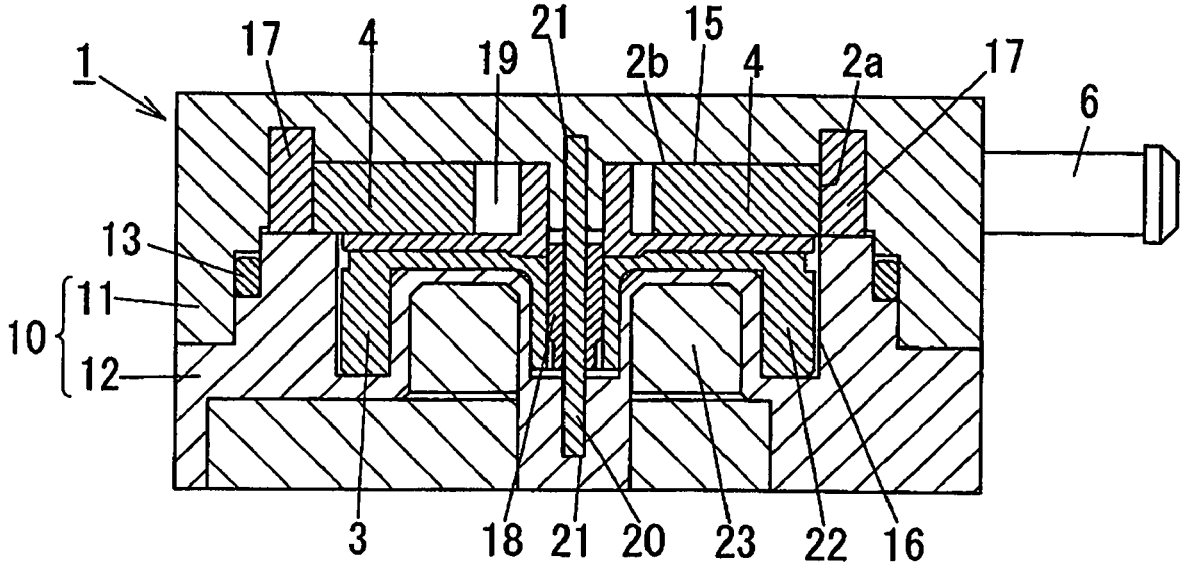
FIG. 4A shows a vertical cross sectional view taken along the line A-A in FIG. 1.
Figure 4B:
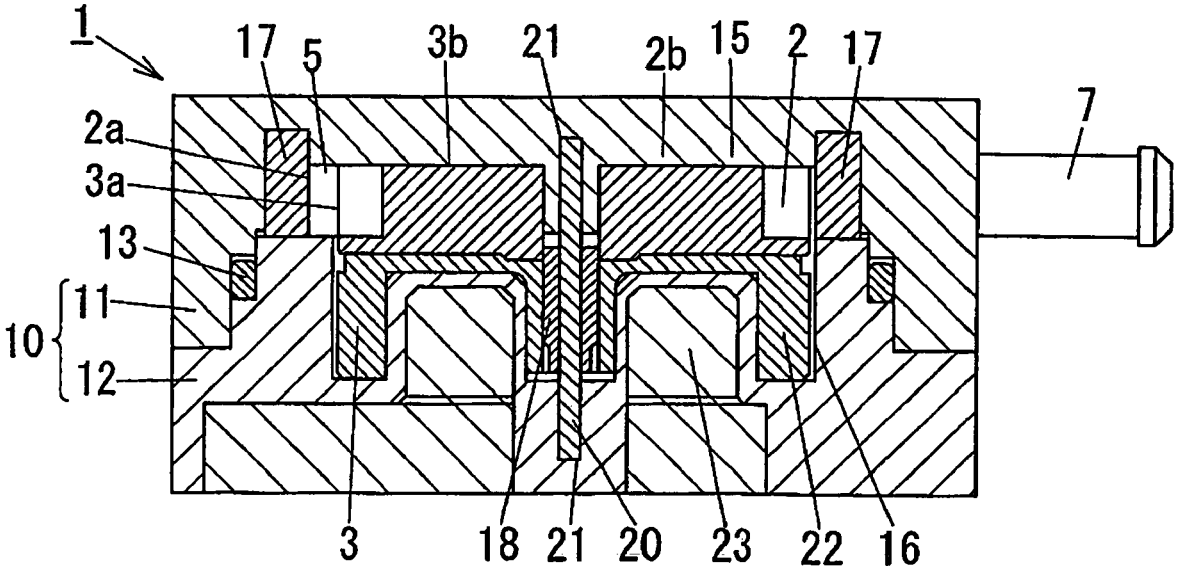
FIG. 4B shows a vertical cross sectional view taken along the line B-B in FIG. 1.

Hereinafter, embodiments of the present invention will be described in detail with reference to the accompanying drawings which form a part hereof.

The vane pump 1 shown in FIGS. 1 to 4B in accordance with an embodiment of the present invention is used as a pump to feed fuel, e.g., to a fuel cell, and includes a casing 10 having a rotor chamber 2 in which a rotor 3 is accommodated eccentrically. A plurality of vanes 4 each having a leading end that makes sliding contact with an inner peripheral surface 2*a* of the rotor chamber 2 is mounted to the rotor 3. The casing 10 is provided with an inlet port 6 and an outlet port 7 leading to the rotor chamber 2. As the rotor 3 is rotatably driven, working compartments 5 surrounded by inner surfaces of the rotor chamber 2, an outer peripheral surface 3*a* of the rotor 3 and the vanes 4 undergo a volume change and a working fluid drawn into the working compartments 5 from the inlet port 6 is discharged through the outlet port 7. Such a configuration of the vane pump 1 will be described in detail hereinbelow.

A thrust direction of the rotor 3 (an axial direction of the rotor 3) of the embodiment of the present invention runs vertically. The casing 10 that accommodates the rotor 3 therein is formed of an upper case 11 positioned above the rotor 3 and a lower case 12 arranged below the rotor 3, both of which are combined together with a packing 13 interposed therebetween. Reference numeral 14 in FIG. 1 designates fastener holes through which fasteners are inserted to couple the upper case 11 and the lower case 12 together. The upper case 11 has an upper recess 15 upwardly recessed from a coupling surface thereof coupled to the lower case 12. The lower case 12 has a lower recess 16 downwardly recessed from a coupling surface thereof coupled to the upper case 11. The upper recess 15 and the lower recess 16 are combined together to form the rotor chamber 2.

The rotor 3 has an upper portion positioned in the upper recess 15 and a lower portion lying in the lower recess 16. The upper recess 15 has an inner diameter greater than an outer diameter of the rotor 3, and the lower recess 16 has an inner diameter substantially the same as the outer diameter of the rotor 3. In other words, the lower recess 16 is formed to have an inner diameter smaller than that of the upper recess 15, so that, when the upper case 11 and the lower case 12 are combined together, the lower recess 16 is positioned eccentrically from the upper recess 15 just like the rotor 3. A ring member 17 is fitted to an inner periphery of the upper recess 15 in such a way that an inner peripheral surface of the ring member 17 forms the inner peripheral surface 2*a* of the rotor chamber 2.

Although the rotor chamber 2 has a circular cross section when viewed in the thrust direction of the rotor 3, the inner peripheral surface 2*a* may be readily changed into an arbitrary shape such as an elliptical shape or the like when seen in the thrust direction of the rotor 3 by varying the shape of the inner peripheral shape of the inner circumference of the ring member 17. Further, formed in the upper case 11 are the inlet port 6 through which the working fluid is drawn into the working compartments 5 and the outlet port 7 through which the working fluid is discharged from the working compartments 5. The inlet port 6 and the outlet port 7 are in communication with the rotor chamber 2, i.e., the working compartments 5, via though-holes 17*a*. At a lower part of the lower case 12, there is arranged a stator 23 near an inner bottom surface of the lower recess 16.

The rotor 3 has a central bearing portion 18 and is formed into a circular shape when seen in the thrust direction. A plurality of vane grooves 19 (in this embodiment, four vane grooves) elongating in the radial direction of the rotor 3 are formed at the upper portion of the rotor 3 along the circumferential direction of the rotor 3 with a regular interval therebetween, wherein each of the vane grooves 19 is opened at the outer peripheral surface 3*a* and the upper surface of the rotor 3. Further, a magnetic body 22 made of magnets is integrally attached to the lower portion of the rotor 3.

The bearing portion 18 of the rotor 3 is rotatably fitted to a rotating shaft 20 vertically extending through the rotor chamber 2, whereby the rotor 3 is rotatably arranged within the rotor chamber 2 in such a fashion that the outer peripheral surface 3*a* of the rotor 3 faces the inner peripheral surface 2*a* of the rotor chamber 2 and the thrust surface (top surface 3*b*) of the rotor 3 faces an inner ceiling surface 2*b* of the rotor chamber 2, which is a bottom surface of the upper recess 15. The rotating shaft 20 is non-rotatably secured to shaft fixing portions 21 provided at an off-centered position of the inner ceiling surface 2*b* of the rotor chamber 2 and a central position of the inner bottom surface of the lower recess 16.

The vanes 4 are slidably inserted into the respective vane grooves 19 of the rotor 3. Thus, the respective vanes 4 are free to move in the radial direction of the rotor 3 and are free to protrude above and retreat below the outer peripheral surface 3*a* of the rotor 3.

The magnetic body 22 is disposed adjacent to the stator 23 when the rotor 3 is disposed in the rotor chamber 2 and the magnetic body 22 and the stator 23 constitute a driving part to rotate the rotor 3 in a direction indicated by an arrow "a" of FIG. 1. In other words, when an electric current is inputted to the stator 23 from a power source (not shown), the driving part generates a rotational torque to the magnetic body 22 by the magnetic interaction between the stator 23 and the magnetic body 22. The magnetic body 22 and the rotor 3 are rotatably driven by the torque thus generated.

As the rotor 3 accommodated in the rotor chamber 2 is rotatably driven by the driving part, the respective vanes 4 are protruded radially outward from the outer peripheral surface 3*a* of the rotor 3 under the influence of a centrifugal force exerted by rotation of the rotor 3. Therefore, the leading ends of the vanes 4 can make sliding contact with the inner peripheral surface 2*a* of the rotor chamber 2. Thus, the rotor chamber 2 is divided into a plurality of the working compartments 5, each of which is surrounded by the inner surfaces (the inner peripheral surface 2*a*, the inner ceiling surface 2*b*, etc.) of the rotor chamber 2, the outer peripheral surface 3*a* of the rotor 3 and the vanes 4. Since the rotor 3 is arranged at an eccentric position in the rotor chamber 2, the distance between the inner peripheral surface 2*a* of the rotor chamber 2 and the outer peripheral surface 3*a* of the rotor 3 varies with the angular positions of the rotor 3 and, similarly, the protruding amounts of the vanes 4 relative to the rotor 3 vary depending on the angular positions of the rotor 3.

In other words, the rotation of the rotor 3 moves the respective working compartments 5 in the rotating direction of the rotor 3, during which time the volume of each working compartment 5 is varied between its lower and upper limits. That is, when each of the working compartments 5 is positioned to communicate with the inlet port 6, the volume thereof is increased with the rotation of the rotor 3. When each of the working compartments 5 is positioned to communicate with the outlet port 7, the volume thereof is reduced with the rotation of the rotor 3. Therefore, if the rotor 3 is rotatably driven, the working fluid is drawn into the working compartment 5 communicating with the inlet port 6 and then is pressurized in the working compartment 5, to thereby discharge the working fluid through the outlet port 7. This realizes the function of a pump.

Here, in the portions of the outer peripheral surface 3*a* of the rotor 3 between every neighboring vanes 4 (vane grooves 19), a plurality of blade base members 27 is integrally formed with the outer peripheral surface 3*a* in the circumferential direction of the rotor 3. The respective blade base members 27 are formed in the circumferential direction of the rotor 3 with a regular interval therebetween. The respective blade base members 27 protrude outwardly in the radial direction from the outer peripheral surface 3*a* of the rotor 3 and the protruding length of each blade base members 27 is set to a length not to contact with the inner peripheral surface 2*a* of the rotor chamber 2. A leading side of each blade base member 27 in the rotating direction of the rotor 3 (direction indicated by an arrow "a") is perpendicular to the circumferential direction of the rotor 3.

Blade base grooves 28 opened at the outer peripheral surface 3*a* of the rotor 3 are formed between the blade base members 27 and both ends of the blade base grooves 28 in the thrust direction of the rotor 3 are closed. By providing the blade base members 27 protruded from the outer peripheral surface 3*a* of the rotor 3 between the vanes 4 adjacent to each other as described above, vortex flows are generated, as indicated by an arrow "b" in FIG. 1, in the working fluid in the working compartments 5 formed between the outer peripheral surface 3*a* of the rotor 3 and the inner peripheral surface 2*a* of the rotor chamber 2. Accordingly, the pressure of the working fluid increases and thus the working fluid can be effectively pumped out through the outlet port 7.

Figure 5:
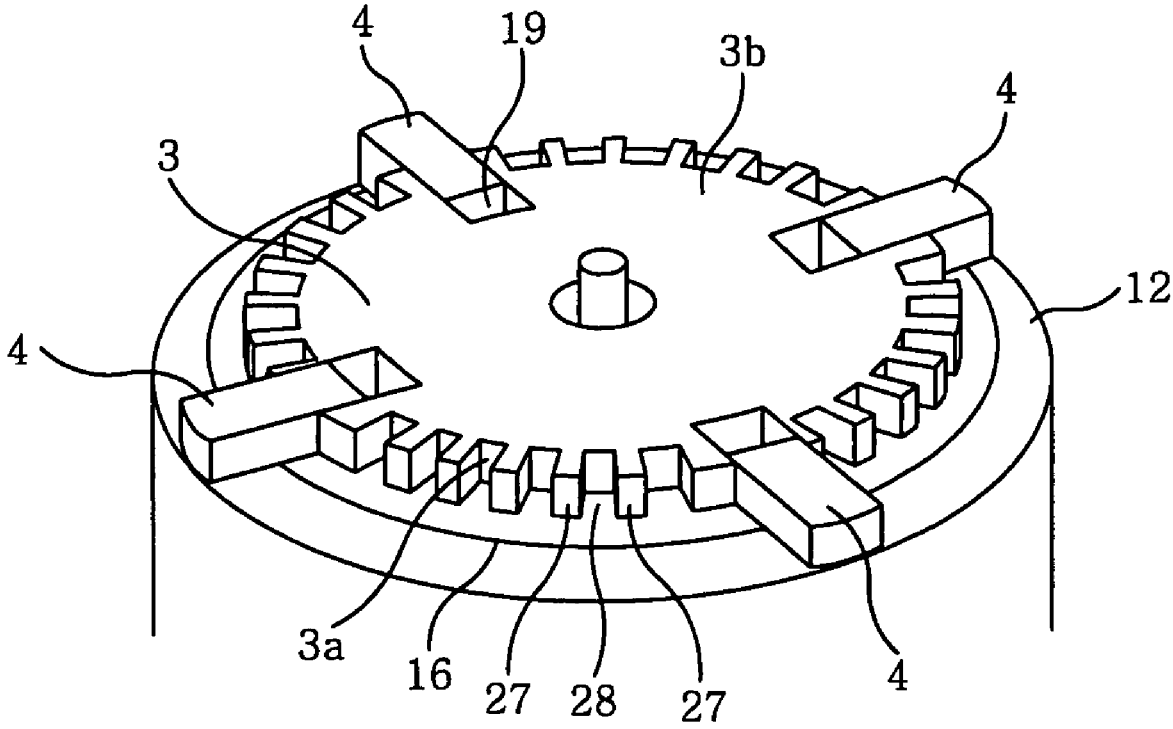
FIG. 5 shows a perspective view illustrating blade base members of a rotor of a vane pump in accordance with another embodiment of the present invention.
Figure 6A:
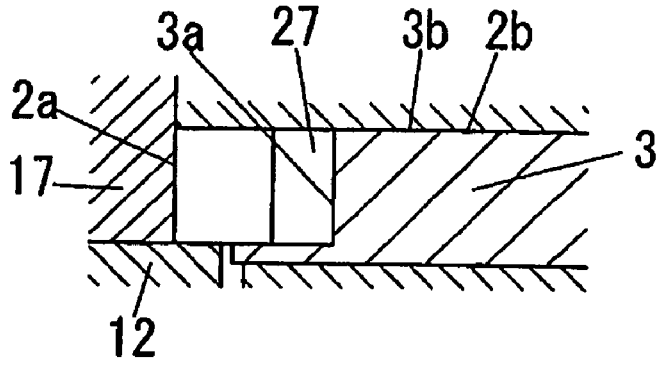
FIG. 6A shows an enlarged vertical cross sectional view illustrating neighborhoods of the blade base members.

Moreover, although each of the blade base grooves 28 in accordance with the above embodiment of the present invention is closed at the both ends in the thrust direction of the rotor 3, it is preferable that each of the blade base grooves 28 is opened at one or both of the upper and the lower thrust surfaces 3*b* of the rotor 3. In the embodiments as shown in FIGS. 5 and 6A, a top surface forming one of both thrust surfaces of the rotor 3 in the thrust direction (i.e., the upper thrust surface 3*b* of the rotor 3) is made to be an opening side thrust surface 3*b* so that one end of each blade base grooves 28 in the thrust direction is opened at the opening side thrust surface 3*b*. In the example shown in FIG. 6A, the protruding end surface of each of the respective blade base members 27 is a flat surface perpendicular to the radial direction of the rotor 3.

Figure 6B:
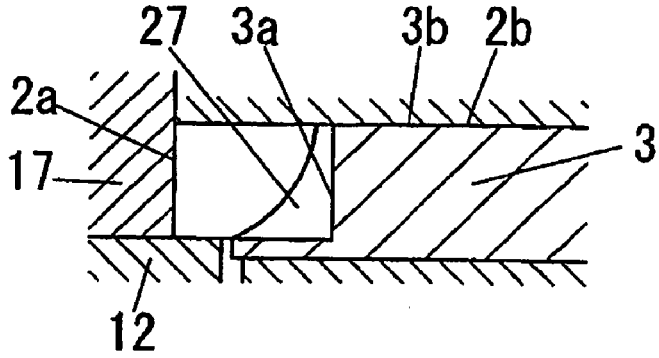
FIGS. 6B and 6C show enlarged vertical cross sectional views illustrating neighborhood of blade base members of a rotor of a vane pump in accordance with still another embodiments of the present invention.
Figure 6C:
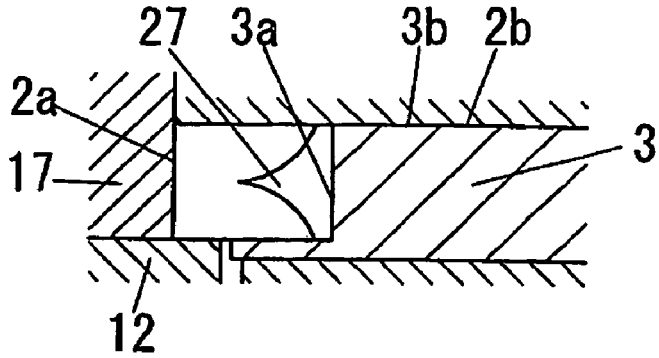

A cross sectional shape of the protruding end surface of each blade base member 27 when viewed in the rotating direction of the rotor 3 can have a flat cross sectional surface perpendicular to the radial direction of the rotor 3 as shown in FIG. 6A or can be cross sectional shapes shown in FIGS. 6B and 6C.

In FIG. 6B, the protruding end surface of the blade base member 27 has an arc shaped curved surface configured such that the closer to the opening side thrust surface 3*b* a part of the protruding end surface is, the more inner side in the radial direction of the rotor 3 (the closer to the rotational axis of the rotor 3) the part of the protruding end surface is positioned in a manner of being gradually convex to the rotational axis of the rotor 3.

In an example shown in FIG. 6C, one half of the protruding end surface of each blade base member 27 next to the opening side thrust surface 3*b* has an arc shaped curved surface configured such that the closer to the opening side thrust surface 3*b* a part of the protruding end surface is, the more inner side in the radial direction of the rotor 3 (the closer to the rotational axis of the rotor 3) the part of the protruding end surface is positioned in a manner of being gradually convex to the rotational axis of the rotor 3. Further, the opposite half of the protruding end surface positioned away from the opening side thrust surface 3*b* has an arc shaped curved surface configured such that the closer to the opposite side of the opening side thrust surface 3*b*, the more inner side in the radial direction of the rotor 3 the part of the protruding end surface is positioned in a manner of being gradually convex to the rotational axis of the rotor 3. In FIGS. 6A to 6C, one end surface of each of the blade base members 27 in the thrust direction of the rotor 3 is flush with the opening side thrust surface 3*b*.

As described above, the blade base grooves 28, which are formed between the blade base members 27 adjacent to each other, are opened at the opening side, i.e., upper thrust surface 3*b* of the rotor 3. Therefore, the working fluid in the blade base grooves 28 of the rotating rotor 3 can make contact with the inner ceiling surface 2*b* of the rotor chamber 2 through the corresponding openings and then flows of the working fluid are generated therebetween. Consequently, the pressure of the working fluid in the working compartments 5 increases and the working fluid is effectively pumped out through the outlet port 7.

In the embodiments shown in FIGS. 6A to 6C, each of the blade base grooves 28 is opened only at one of both thrust surfaces 3*b* of the rotor 3, but each of the ends thereof in the thrust direction of the rotor 3 may be opened at the upper and the lower thrust surfaces of the rotor 3. In such a case, the working fluid in each of the blade base grooves 28 of the rotor 3 can make contact with the inner ceiling surface 2*b* and an inner bottom surface of the rotor chamber 2 facing the upper and the lower thrust surface of the rotor 3, so that stronger vortex flows can be generated in the working fluid in each of the blade base grooves 28.

Figure 7A:
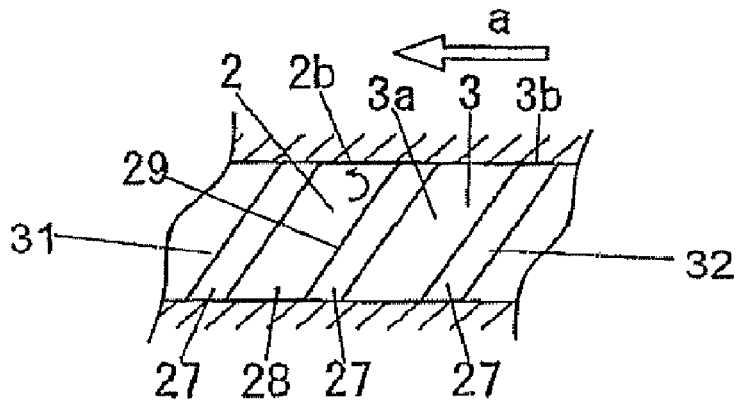
FIGS. 7A to 7C show views illustrating blade base members of a rotor of a vane pump in accordance with still another embodiment of the present invention.
Figure 7B:
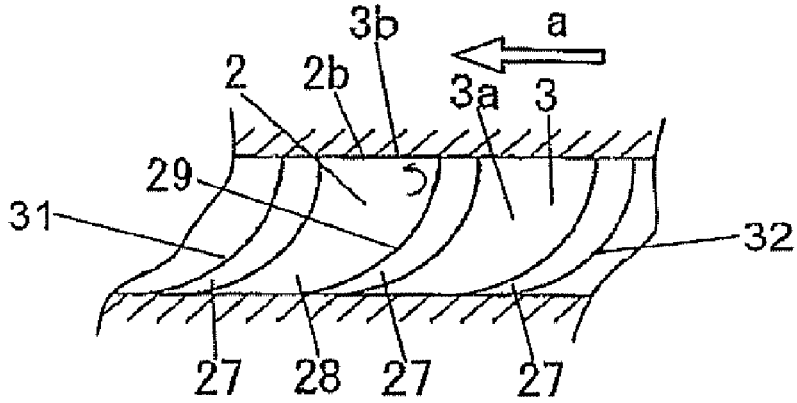
Figure 7C:
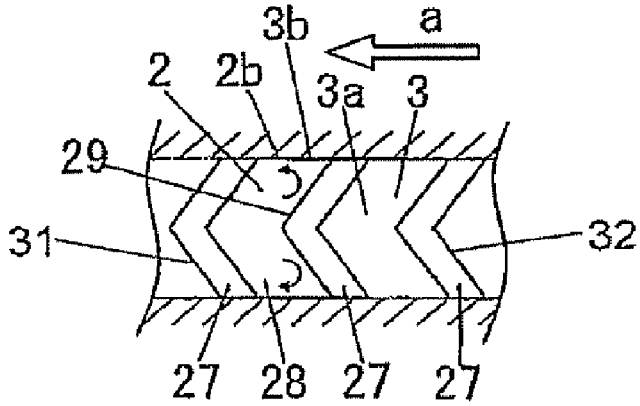

In the case where each of the blade base grooves 28 is opened at the opening side thrust surface (i.e., top thrust surface) 3*b* as shown in FIGS. 6A to 6C, it is preferable that a guide surface 29 is formed at a leading side 31 of each of the blade base members 27 as viewed in a rotating direction of the rotor 3, as shown in FIGS. 7A to 7C. The guide surface 29 is formed at least at a portion of the leading side of each of the blade base member 27 next to the opening side thrust surface 3*b*. The guide surface 29 is preferably configured such that the closer to the opening side thrust surface 3*b* a part of the guide surface 29 is, the more trailing side 32 the part of the guide surface 29 is located as viewed in the rotating direction of the rotor 3.

Each of the blade base grooves 28 in FIGS. 7A to 7C is opened at one of both thrust surfaces of the rotor 3, i.e., at the opening side thrust surface 3*b* (the top surface) of the rotor 3. In FIG. 7A, each of the blade base members 27 is inclined such that the closer to the opening side thrust surface 3*b* a part of each of the blade base members 27 is, the more trailing side 32 the part of each of the blade base members 27 is located as viewed in the rotating direction of the rotor 3. The leading side 31 of each of the blade base members 27 as viewed in the rotating direction of the rotor 3 has an inclined flat surface configured such that the closer to the opening side thrust surface 3*b* a part of the inclined flat surface is, the more trailing side 32 the part of the inclined flat surface is located as viewed in the rotating direction of the rotor 3. The inclined flat surface functions as the guide surface 29.

Further, in FIG. 7B, each of the blade base members 27 is curved in an arc shape convex to the rotational axis of the rotor 3 such that the closer to the opening side thrust surface 3*b* a part of each of the blade base members 27 is, the more trailing side 32 the part of each of the blade base members 27 is located as viewed in the rotating direction of the rotor 3. Accordingly, the leading side 31 of each of the blade base members 27 as viewed in the rotating direction of the rotor 3 has an arc shaped surface curved such that the closer to the opening side thrust surface 3*b* a part of the arc shaped surface is, the more trailing side 32 the part of the arc shaped surface is located as viewed in the rotating direction of the rotor 3. The arc shaped surface serves as the guide surface 29.

Moreover, in FIG. 7C, a cross section of each of the blade base members 27 is formed in a V-shape wherein one half of the leading side 31 of each of the blade base members 27 at the opening side thrust surface (i.e., the upper thrust surface) 3*b* side, has a inclined flat surface configured such that the closer to the upper or the lower thrust surface 3*b* a part of the flat surface is, the more trailing side 32 the part of the flat surface is located as viewed in the rotating direction of the rotor 3. The flat surface functions as the guide surface 29. Further, in FIGS. 7A to 7C, the upper end surface of each of the blade base members 27 in the thrust direction of the rotor 3 is flush with the opening side thrust surface (i.e., the upper thrust surface) 3*b*.

As shown in FIGS. 7A to 7C, the guide surface 29 is formed at the leading side 31 of each of the blade base members 27 as viewed in the rotating direction of the rotor 3. Therefore, as the rotor 3 is rotatably driven, vortex flows are generated in the working fluid in each of the base grooves 28 to flow from each of the blade base grooves 28 toward the opening side thrust surface 3*b* along the guide surfaces 29 as indicated by arrows in FIGS. 7A to 7C. Accordingly, the pressure of the working fluid increases and the working fluid in the working compartment 5 can be effectively pumped out through the outlet port 7.

As shown in the embodiments of FIGS. 6A to 6C, the embodiments of FIGS. 7A to 7C can also be configured such that both ends of each of the blade base grooves 28 in the thrust direction of the rotor 3 are opened at both thrust surfaces of the rotor 3 respectively to allow the working fluid in each of the blade base grooves 28 of the rotor 3 to make contact with the inner ceiling surfaces 2*b* and the inner bottom surface of the rotor chamber 2 facing the upper and the lower thrust surface of the rotor 3, respectively.

Figure 8A:
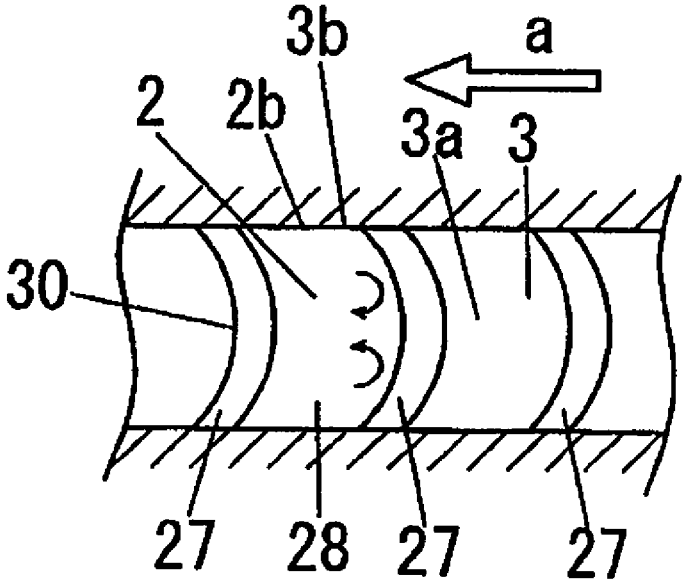
FIGS. 8A to 8B show views illustrating base portions of a rotor of as vane pump in accordance with still another embodiment of the present invention.
Figure 8B:
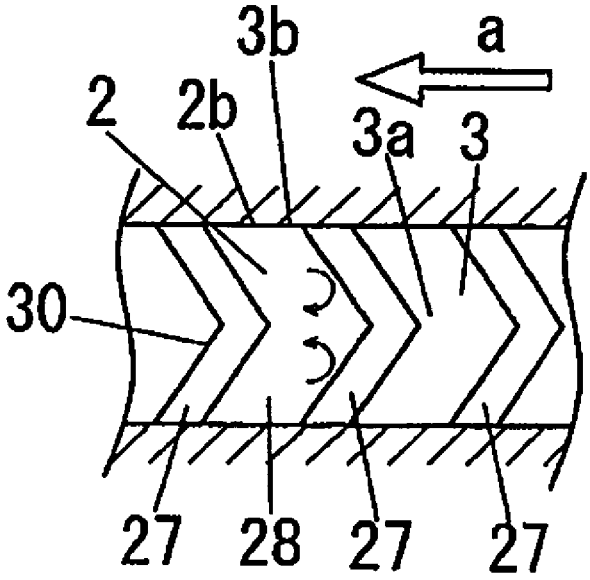

Further, as shown in FIGS. 8A to 8B, it is also preferable that a leading side of each of the blade base members 27 as viewed in a rotating direction of the rotor 3 is formed such that a central part of the leading side in the thrust direction of the rotor 3 is positioned at a trailing side of two opposite end parts of the leading side as viewed in the rotating direction of the rotor 3. In FIG. 8A, the bent surfaces 30 are formed by forming each of the blade base members 27 in an arc shape. In FIG. 8B, the bent surfaces 30 are formed by forming cross section of each of the blade base members 27 in the V-shape.

As shown in FIGS. 8A and 8B, a leading side surface of each of the blade base members 27 as viewed in a rotating direction of the rotor 3 is formed such that a central part of the leading side surface in the thrust direction of the rotor 3 is positioned at a trailing side of the two opposite end parts of the leading side surface as viewed in the rotating direction of the rotor 3. Thus as the rotor 3 is rotatably driven, vortex flows are generated in the working fluid in each of the base grooves 28 to flow from two end sides in the thrust direction of the rotor 3 toward the center along the bent surfaces 30. Accordingly, the pressure of the working fluid in the working compartments 5 increases and the working fluid can be effectively pumped out through the outlet port 7.

Figure 9:
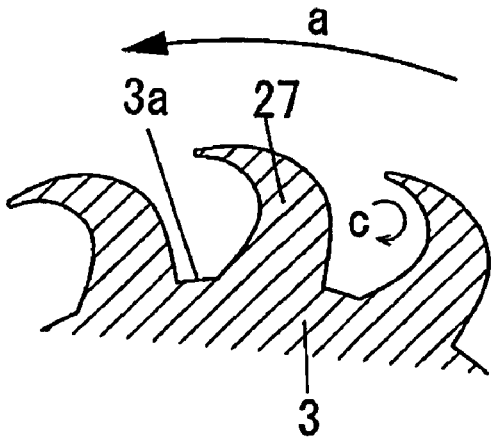
FIG. 9 shows a horizontal cross sectional view illustrating blade base members of a rotor of a vane pump in accordance with still another embodiment of the present invention.

Further, as shown in FIG. 9, it is preferable that a free end of each of the blade base members 27 protruded from the outer peripheral surface 3*a* of the rotor 3 extends toward a leading side of the rotating direction of the rotor 3. In the example shown in FIG. 9, the protruding end of each of the blade base members 27 that are protruded from the outer peripheral surface 3*a* of the rotor 3 in the radial direction of the rotor 3 is curved toward the leading side as viewed in the rotating direction of the rotor 3.

As shown in FIG. 9, the protruding end of each of the blade base members 27 is curved toward the leading side as viewed in the rotating direction of the rotor 3. Therefore, vortex flows are generated in the working fluid in each of the blade base grooves 28 to flow from the protruding ends of the blade base members 27 toward the base ends. As a consequence, the pressure of the working fluid in the working compartments 5 increases so that the working fluid can be effectively pumped out through the outlet port 7.

Figure 10:
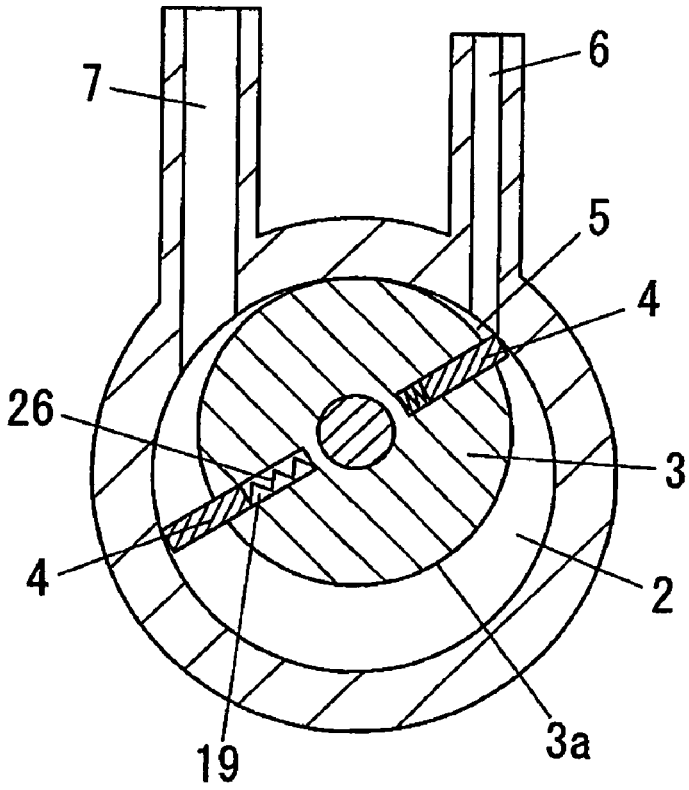
FIG. 10 (PRIOR ART)
FIG. 10 shows a cross sectional view illustrating a conventional vane pump.

In the embodiments described above, the vanes 4 are protruded outwardly by the centrifugal force exerted by the rotation of the rotor 3. However, spring members 26 (see FIG. 10) that outwardly bias the vanes 4 may be inserted into the vane grooves 19 to ensure that the leading ends of the vanes 4 can make reliable sliding contact with the inner peripheral surface 2*a* of the rotor chamber 2 without resort to the rotating speed of the rotor 3. Moreover, in the embodiment described above, the rotor 3 is rotatably fitted to a fixed shaft 20. However, it may be possible to employ a structure in which a rotating shaft fixed to the rotor 3 is rotatably fitted with respect to the rotor chamber 2 instead of the fixed shaft 20. Further, in the embodiment described above, the driving part for rotatably driving the rotor 3 is formed of the stator 23 and the magnetic body 22 that magnetically interact with each other. However, it may be possible to employ, as the driving part, a structure in which a shaft fixed to the rotor 3 is rotatably driven by an electric motor. Further, the vane pump 1 exemplified in embodiments of the present invention is used as a pump to feed fuel to the fuel cell, but is not limited thereto. Moreover, the working fluid may be any gas or liquid.

While the invention has been shown and described with respect to the preferred embodiments, it will be understood by those skilled in the art that various changes and modifications may be made without departing from the scope of the invention as defined in the following claims.

What is claimed is:

1. A vane pump comprising:

a rotor accommodated in a rotor chamber;

a plurality of vanes attached to the rotor, each of the vanes having a leading end adapted to make sliding contact with an inner peripheral surface of the rotor chamber;

working compartments surrounded by inner surfaces of the rotor chamber, an outer peripheral surface of the rotor and the vanes, the working compartments being adapted to undergo a volume change as the rotor is rotatably driven;

an inlet port through which a working fluid is drawn into a working compartment whose volume is being increased; and an outlet port through which the working fluid is discharged from a working compartment whose volume is being decreased; and at least one blade base member protruded from portions on the outer peripheral surface of the rotor between the vanes adjacent to each other, wherein a guide surface formed at a leading side of each of the blade base members as viewed in a rotating direction of the rotor is inclined with respect to a thrust direction of the rotor.

2. The vane pump of claim 1, wherein a plurality of blade base members is disposed in a circumferential direction of the rotor and is protruded from the portions between the vanes adjacent to each other, and blade base grooves are formed between the blade base members adjacent to each other and are opened at one or both of an upper and a lower thrust surface of the rotor.

3. The vane pump of claim 2, wherein the blade base grooves are opened at one of the thrust surfaces, and wherein at least a portion of the guide surface disposed at a side of said one of the thrust surfaces is configured such that a part of the guide surface which is closer to said one of the thrust surfaces is located more to a trailing side as viewed in the rotating direction of the rotor.

4. The vane pump of claim 2, wherein the blade base grooves are opened at one of the thrust surfaces, and wherein at least a portion of the guide surface disposed at a side of said one of the thrust surfaces is configured such that the portion of the guide surface is inclined backwards as viewed in the rotating direction of the rotor.

5. The vane pump of claim 1, wherein the guide surface is formed such that a central part of the leading side in the thrust direction of the rotor is positioned at a trailing side of two opposite end parts of the leading side as viewed in the rotating direction of the rotor.

6. The vane pump of claim 1, wherein a free end of each of the blade base members that are protruded from the outer peripheral surface of the rotor extends toward the leading side of the rotating direction of the rotor.

* * * * *